US009505100B2

(12) United States Patent
Ozaki

(10) Patent No.: US 9,505,100 B2
(45) Date of Patent: Nov. 29, 2016

(54) GRINDING TOOL

(71) Applicant: Kobe Steel, Ltd., Hyogo (JP)

(72) Inventor: Katsuhiko Ozaki, Kobe (JP)

(73) Assignee: KOBE STEEL, LTD., Hyogo (JP)

( * ) Notice: Subject to any disclaimer, the term of this patent is extended or adjusted under 35 U.S.C. 154(b) by 0 days.

(21) Appl. No.: 14/769,680

(22) PCT Filed: Feb. 7, 2014

(86) PCT No.: PCT/JP2014/052973

§ 371 (c)(1),
(2) Date: Aug. 21, 2015

(87) PCT Pub. No.: WO2014/132782

PCT Pub. Date: Sep. 4, 2014

(65) Prior Publication Data

US 2015/0375364 A1 Dec. 31, 2015

(30) Foreign Application Priority Data

Feb. 26, 2013 (JP) ..... 2013-035985

(51) Int. Cl.

| | |
|---|---|
| ***B24B 41/04*** | (2006.01) |
| ***B24B 41/02*** | (2006.01) |
| ***B24D 5/02*** | (2006.01) |
| ***B24D 5/16*** | (2006.01) |

(52) U.S. Cl.

CPC ..... *B24B 41/02* (2013.01); *B24B 41/042* (2013.01); *B24D 5/02* (2013.01); *B24D 5/165* (2013.01)

(58) Field of Classification Search

CPC ..... B24B 41/02; B24B 41/042; B24B 41/04; B24B 45/00; G01M 1/36; B24D 5/165; B24D 5/02; Y10T 464/50

USPC ..... 451/360, 343; 464/106, 150, 180; 188/378

See application file for complete search history.

(56) References Cited

U.S. PATENT DOCUMENTS

| | | | | |
|---|---|---|---|---|
| 1,211,488 A * | 1/1917 | Reed | F16C 3/28 | 451/343 |
| 2,637,148 A * | 5/1953 | Tingvatne | B24B 45/00 | 451/342 |
| 3,130,523 A * | 4/1964 | Monnet | B24B 41/042 | 451/343 |
| 4,905,776 A * | 3/1990 | Beynet | E21B 7/24 | 175/320 |

(Continued)

FOREIGN PATENT DOCUMENTS

| | | |
|---|---|---|
| CN | 101048101 A | 10/2007 |
| JP | H02-232174 A | 9/1990 |

(Continued)

OTHER PUBLICATIONS

International Search Report and Written Opinion of the International Searching Authority, PCT/JP2014/052973, Mar. 4, 2014.

*Primary Examiner* — George Nguyen
(74) *Attorney, Agent, or Firm* — Studebaker & Brackett PC

(57) ABSTRACT

The rotation support bar (2) of a grinding tool (1) has a bendable hinge section (4) at the intermediate section thereof, and has a balancer (5) on the grinding stone tip (3) side. The hinge section (4) comprises two or more opposed pairs of grooves (4*a*) which have circular arc-shaped bottom surfaces and which are provided in the outer peripheral surface of the rotation support bar (2) so as to extend in the direction perpendicular to the axial direction of the rotation support bar (2). The grooves (4*a*) are provided at equal angular intervals.

4 Claims, 5 Drawing Sheets

(56) References Cited

U.S. PATENT DOCUMENTS 5,349,786 A * 9/1994 Dorrah ..... B24B 23/03 451/357
5,669,744 A * 9/1997 Hines ..... B23C 5/10 144/136.95
5,688,160 A * 11/1997 Pozzetti ..... B24B 41/042 451/343
6,183,355 B1 * 2/2001 Robinson ..... B24B 23/028 451/415
6,341,600 B1 * 1/2002 Wakita ..... B23Q 11/0035 125/13.01
2001/0048856 A1 * 12/2001 Dyer ..... B23Q 11/0035 409/131
2002/0115383 A1 8/2002 Imami et al.
2003/0207653 A1 11/2003 Kapgan
2004/0127150 A1 * 7/2004 Chen ..... B23B 31/1075 451/360
2005/0227598 A1 * 10/2005 Ploeger ..... B24B 23/02 451/359

FOREIGN PATENT DOCUMENTS

JP 2000-296449 A 10/2000
JP 2001-328066 A 11/2001
JP 2002-346424 A 12/2002
JP 2003-071692 A 3/2003
JP 2006-035414 A 2/2006

* cited by examiner

GRINDING TOOL

TECHNICAL FIELD

The present invention relates to a grinding tool for freely grinding the surface of metallic materials such as iron materials, aluminum material, or copper materials by a uniform grinding force.

BACKGROUND ART

In order to grind the surface of metallic materials such as iron materials, aluminum materials, or copper materials, grinding tools have been conventionally used. In grinding with the use of the conventional grinding tool, by moving the grinding tool with the use of a manually or numerically controlled (NC: Numerical Control) processing machine, grinding of the surface having a planar shape or a shape approximate to a plane could be performed without any hindrance. However, in case of grinding a curved surface or a nonuniform surface, grinding in a state that a positional relationship between a grinding stone tip provided at a leading end of the grinding tool and the surface of the metallic materials is uniform is difficult, so it was difficult to grind the surface of the metallic materials by a uniform grinding force.

As a result, under-grinding portions or over-grinding portions are generated on the surface of the metallic materials after grinding, and depending on the time, some flaws were generated on the surface of the metallic materials. Further, overload may be applied at the time of grinding, a grinding shaft may be broken, or abnormal wear may be generated on the grinding stone tip, so the development of a grinding tool without creating these problems has been conventionally expected.

Based on the above-described background, various studies have been conventionally carried out to realize a desired grinding tool. The invention proposed based on the knowledge that a rotating tool containing 50% by volume or more of inorganic continuous fibers does not require special consideration of the angle at which it abuts on a work-piece and has an excellent sharpness over all directions is the invention described in Patent Document 1. In the Patent Document 1, as an example of the rotating tool suitable for grinding, a rotating tool consisting of a rotating tip which rotates, and a turning shaft for turning the rotating tip is disclosed.

This rotating tool uses fibers of high hardness instead of a grinding stone, and is formed densely using a thermosetting resin as a binder so as to have no holes. As thus configured, the thermosetting resin of the matrix is worn away slightly earlier than the inorganic continuous fibers at the time of cutting (grinding), so the inorganic continuous fibers form a brush-like face protruded slightly from the surface of the matrix. Since this brush-like inorganic continuous fibers become cutting elements, special consideration of the angle at which it abuts on the work-piece is not necessary, and therefore this rotating tool has an excellent sharpness over all directions.

However, in Patent Document 1, only a disk-shaped rotating tool for cutting steel plates is exemplified as embodiments. Further, there is no even suggestion in addition to description of the mechanism thereof, so it is unclear whether the rotating tool described in Patent Document 1 has an excellent grinding force over all directions or not.

Moreover, Patent Document 2 proposes a grinding tool having a grinding stone tip consisting of an inorganic continuous fiber reinforced resin body in which the leading ends of a plurality of inorganic continuous fibers reach a processing surface, and a grinding stone supporting member to which the grinding stone tip is coupled. This grinding tool is characterized in that the grinding stone tip supporting member is elastically deformable in the direction orthogonal to the length direction of the grinding stone tip supporting member.

However, in the grinding tool described in Patent Document 2, if the grinding stone tip supporting member is elastically deformed in the direction orthogonal to the length direction of the grinding stone tip supporting member, the positional relationship (distance) between the grinding stone tip provided at a leading end of the grinding tool and the surface of metallic materials is changed. Therefore, it is considered that the processing force applied to the grinding stone tip will be similarly changed, and that the shape of the processing surface of the metallic materials, the wear volume of the grinding stone tip, or the like will be affected. As a result, it is considered that a stable processing by a uniform grinding force cannot be performed.

CITATION LIST

Patent Document

Patent Document 1: JP H02-232174 A
Patent Document 2: JP 2006-35414 A

SUMMARY OF THE INVENTION

Problem to be Solved by the Invention

The present invention is achieved in consideration of the above conventional reality, and an object thereof is to provide a grinding tool capable of freely grinding a surface of metallic materials such as iron materials, aluminum material, or copper materials by a uniform grinding force, even if the surface of the metallic materials is a curved surface or a nonuniform surface.

Means for Solving the Problem

The present invention is a grinding tool having a columnar rotation support bar, and a grinding stone tip provided at a leading end of the rotation support bar, characterized in that the rotation support bar has a bendable hinge part at the intermediate portion thereof, and has a balancer which suppresses the occurrence of balance failure during rotation on the grinding stone tip side than the hinge part, the hinge part consists of two or more opposed pairs of grooves which have circular arc-shaped bottom surfaces and which are provided in the outer peripheral surface of the rotation support bar so as to extend in the direction orthogonal to the axial direction of the rotation support bar, and the respective grooves are provided at equiangular intervals as viewed from the axial direction of the rotation support bar.

The respective grooves are preferably provided to be displaced in the axial direction of the rotation support bar so as not to intersect with each other.

The depth of the grooves is preferably D/3-D/5 with respect to a diameter D of the rotation support bar.

Effect of the Invention

According to the grinding tool of the present invention, it is possible to freely grind the surface of metallic materials such as iron materials, aluminum materials, or copper materials by a uniform grinding force similar or close to the case of a plane, even if the surface of the metallic materials is a curved surface or a nonuniform surface. As a result, under-grinding portions or over-grinding portions are not generated on the surface of the metallic materials after grinding, and the problems that the surface of the metallic materials may be flawed at the time of grinding, a rotation support bar may be broken, and unbalanced abnormal wear may be generated on a grinding stone tip are not created.

MODES FOR CARRYING OUT THE INVENTION

Hereinafter, the present invention will be described in more detail based on embodiments shown in the accompanying drawings.

Figure 1:
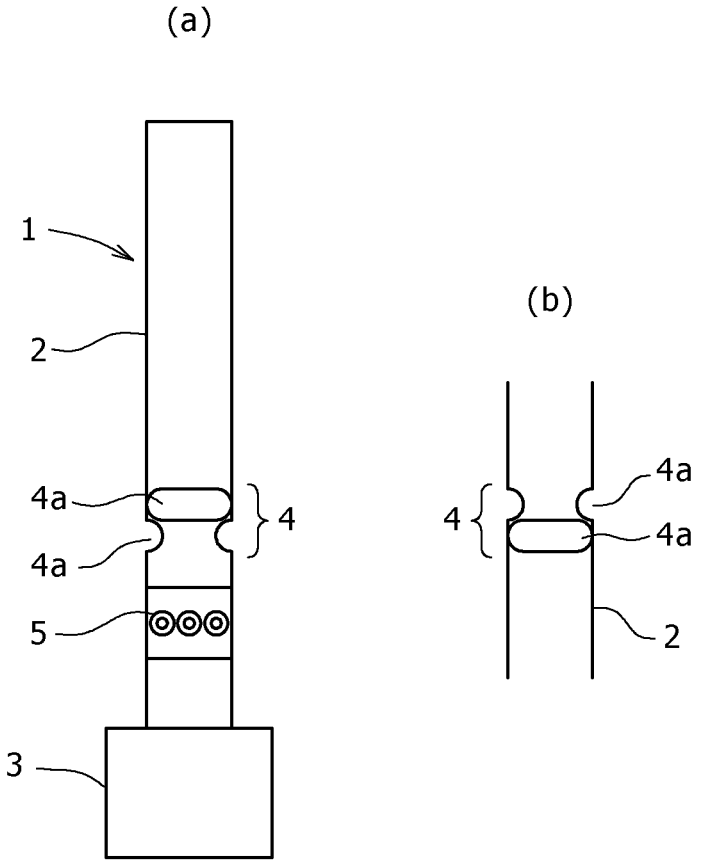
FIG. 1(*a*) is a front view showing a grinding tool according to one embodiment of the present invention, and FIG. 1(*b*) is a side view of only a hinge part of a rotation support bar extracted therefrom.

FIGS. 1(*a*) and (*b*) show a grinding tool 1 according to one embodiment of the present invention. The grinding tool 1 has a columnar rotation support bar 2, and a grinding stone tip 3 fixed by screwing or the like to a leading end of the rotation support bar 2. The rotation support bar 2 is formed of a material having a strength, such as metallic materials such as iron, copper, aluminum, and alloy thereof, or fiber reinforced plastics such as GFRP (Glass Fiber Reinforced Plastic) and CFRP (Carbon Fiber Reinforced Plastic). The grinding stone tip 3 is formed of a material such as a carborundum grinding stone or an aluminum grinding stone. Although not specifically shown, on the base end side (the upper side of FIG. 1(*a*)) of the rotation support bar 2, a shank to be chucked to a rotary device or the like can be provided, for example.

The size of the rotation support bar 2 is a length of for example 10 mm-500 mm and a diameter of for example 2 mm-50 mm. At the intermediate portion of the rotation support bar 2, the bendable hinge part 4 is formed. In the grinding tool 1, on the grinding stone tip 3 side than the hinge part 4, that is, at the midpoint of the hinge part 4 and the grinding stone tip 3, a balancer 5 for suppressing the occurrence of balance failure during rotation of the grinding tool 1 is provided.

Figure 2:
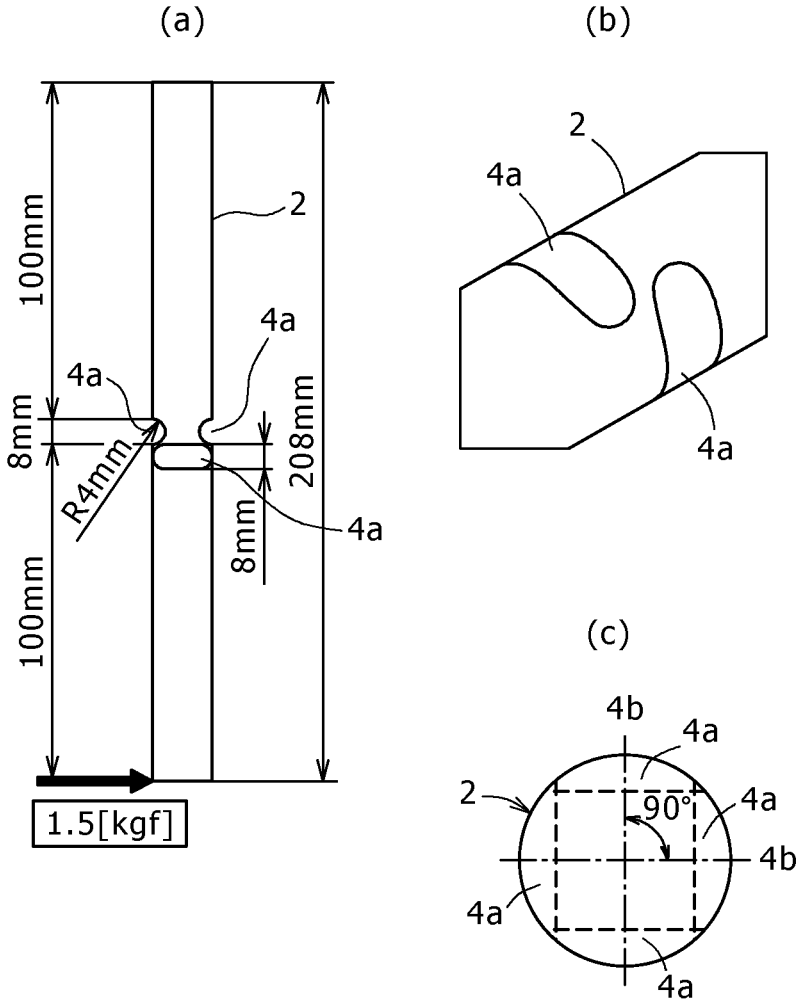
FIG. 2(*a*) is a front view showing only a hinge part of a rotation support bar of a grinding tool of a type having two pairs of grooves according to another embodiment of the present invention, FIG. 2(*b*) is a perspective view of only the hinge part extracted therefrom, and FIG. 2(*c*) is a cross-sectional view of the rotation support bar in the direction orthogonal to the axial direction thereof, showing positions of groove bottoms by virtual lines.
Figure 3:
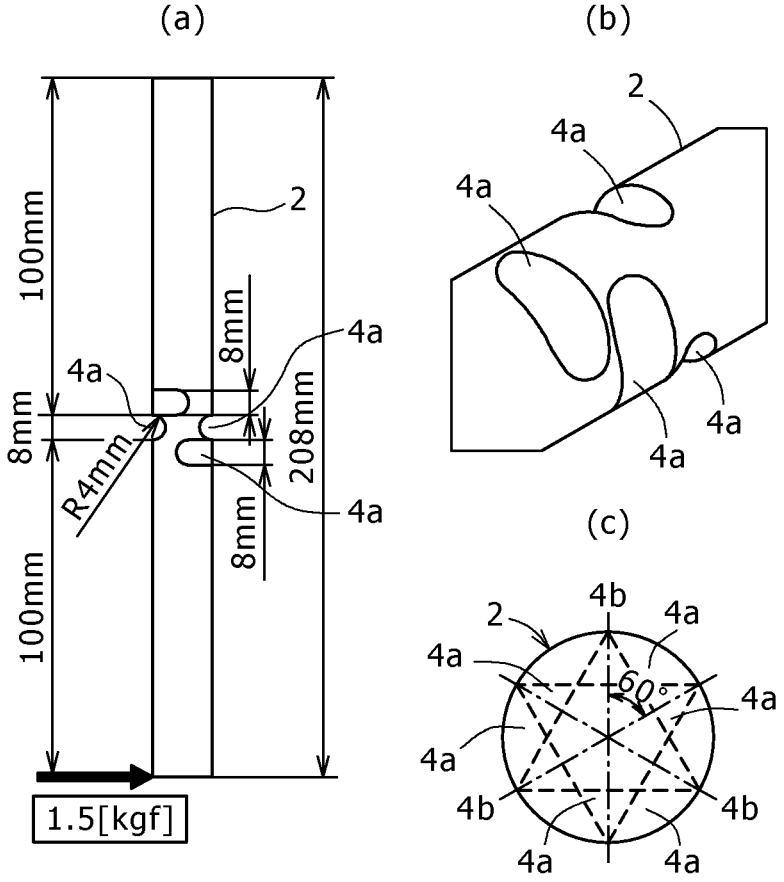
FIG. 3(*a*) is a front view showing a rotation support bar of a grinding tool of a type having three pairs of grooves according to yet another embodiment of the present invention, FIG. 3(*b*) is a perspective view of only the hinge part extracted therefrom, and FIG. 3(*c*) is a cross-sectional view of the rotation support bar in the direction orthogonal to the axial direction thereof, showing positions of groove bottoms by virtual lines.

The hinge part 4 consists of two or more pairs of grooves (R grooves) 4*a* which are provided in the outer peripheral surface of the rotation support bar 2 so as to extend in the direction orthogonal to the axial direction of the rotation support bar 2. The grooves 4*a* have circular arc-shaped bottom surfaces. The cross-sectional shape of the grooves 4*a* is a semi-circular shape, a semi-elliptical shape, or a shape having one or more curvatures. These grooves 4*a* are provided in pairs back to back. Two pairs of the grooves 4*a* (four in total) in the case of the embodiment shown in FIG. 2 and three pairs of grooves 4*a* (six in total) in the case of the embodiment shown in FIG. 3 are provided, and as shown in FIG. 2(*c*) and FIG. 3(*c*), these are provided at equiangular intervals as viewed from the axial direction of the rotation support bar 2. In addition, the dimensions shown in FIGS. 2(*a*)-(*c*) and FIGS. 3(*a*)-(*c*) are dimensions used for models of the embodiments, and the dimensions are not necessarily required.

As shown in FIGS. 2(*a*)-(*c*), in a case where the hinge part 4 consists of two pairs of grooves 4*a*, the two pairs of grooves 4*a* are provided back to back. In this case, four grooves 4*a* are provided at intervals of 90° as viewed from the axial direction of the rotation support bar 2. Specifically, as shown in FIG. 2(*c*), virtual lines 4*b* orthogonal to four grooves 4*a* respectively intersect with each other at intervals of 90°.

Moreover, the respective grooves 4*a* are preferably provided to be displaced in the axial direction of the rotation support bar 2 with respect to each back-to-back pair so as not to intersect with each other. If the two pairs of grooves 4*a* (four in total) are provided together at one place in the axial direction of the rotation support bar 2, only the region where the grooves 4*a* are provided together may get too narrow compared to other regions, which may result in hindrance to strength.

As shown in FIGS. 3(*a*)-(*c*), in a case where the hinge part 4 consists of three pairs of grooves 4*a*, the three pairs of grooves 4*a* are provided back to back respectively. In this case, six grooves 4*a* are provided at equiangular intervals of 60° as viewed from the axial direction of the rotation support bar 2. Specifically, as shown in FIG. 3(*c*), the virtual lines 4*b* orthogonal to six grooves 4*a* respectively intersect with each other at equiangular intervals of 60°.

Moreover, the respective grooves 4*a* are preferably provided to be displaced in three steps in the axial direction of the rotation support bar 2 with respect to each back-to-back pair so as not to intersect with each other. If the three pairs of grooves 4*a* (six in total) are provided together at one place in the axial direction of the rotation support bar 2, only the region where the grooves 4*a* are provided together may get too narrow compared to other regions, which may result in hindrance to strength.

Moreover, although not specifically shown, in a case where the hinge part 4 consists of six pairs of grooves 4*a*, the six pairs of grooves 4*a* are provided back to back respectively. In this case, twelve grooves 4*a* are provided at intervals of 30° as viewed from the axial direction of the rotation support bar 2. Specifically, the virtual lines 4*b* orthogonal to twelve grooves 4*a* respectively intersect with each other at intervals of 30°.

Moreover, the respective grooves 4*a* are preferably provided to be displaced in six steps in the axial direction of the rotation support bar 2 with respect to each back-to-back pair so as not to intersect with each other. If the six pairs of grooves 4*a* (twelve in total) are provided together at one place in the axial direction of the rotation support bar 2, only the region where the grooves 4*a* are provided together may get too narrow compared to other regions, which may result in hindrance to strength.

With respect to a diameter D of the rotation support bar 2, the depth of grooves 4*a* is D/3-D/5. If the depth of the grooves 4*a* is deeper than D/3, hindrance to strength may be caused. On the other hand, if the depth of the grooves 4*a* is shallower than D/5, deformation of the rotation support bar 2 at the time of grinding becomes insufficient, and it is impossible to freely grind by a uniform grinding force in a case where the surface of the metallic material to be ground is a curved surface or a nonuniform surface.

The balancer 5 is formed of materials larger in specific gravity than the material forming the rotation support bar 2, and for example, steel balls, lead balls or the like can be adopted. The balancer 5 can be attached to the rotation support bar 2 by embedding it in the surface of the rotation support bar 2 so as to surround the circumference of the rotation support bar 2.

Figure 4:
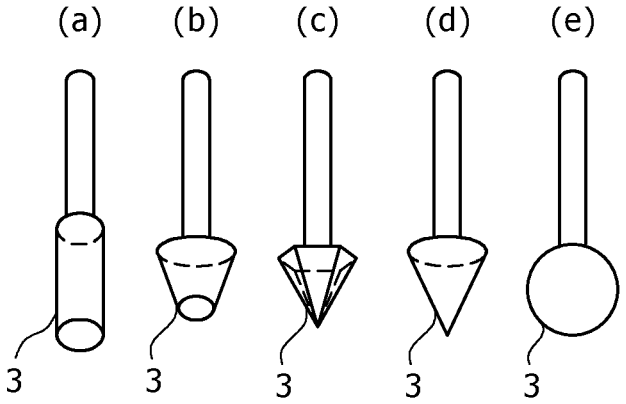
FIGS. 4(*a*), (*b*), (*c*), (*d*) and (*e*) are perspective views each showing a shape of various grinding stone tips.

Moreover, as the shape of the grinding stone tip 3, various shapes such as a conical shape, a hemispherical shape, and a spherical shape as shown in FIGS. 4(*b*)-(*e*) can be adopted, in addition to a columnar shape as shown in FIG. 1 and FIG. 4(*a*).

Embodiments

Hereinafter, the present invention will be more specifically described with embodiments, but the present invention is basically not limited to the following embodiments. The present invention can be implemented by appropriately adding modifications within a range adaptable to the purport of the present invention, and any of the modifications are included in the technical scope of the present invention.

A deformation analysis was conducted using the models of the rotation support bar 2 shown in FIGS. 2(*a*)-(*c*) and FIGS. 3(*a*)-(*c*). The type shown in FIGS. 2(*a*)-(*c*) is the model provided with two pairs of grooves (four in total), and the type shown in FIGS. 3(*a*)-(*c*) is the model provided with three pairs of grooves (six in total).

Figure 5:
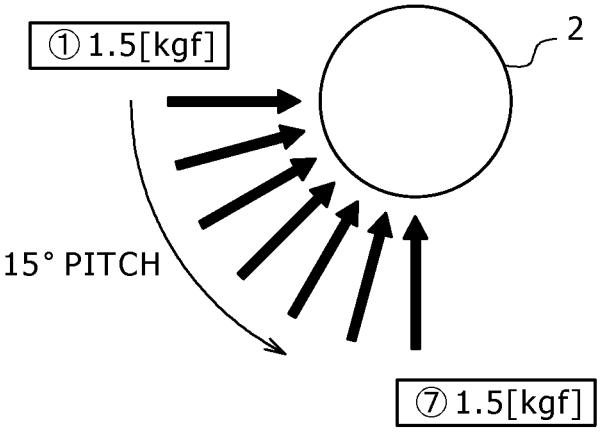
FIG. 5 is an explanatory view showing a direction in which a load is applied to a lower end of the rotation support bar in a deformation analysis of the embodiments.
Figure 6:
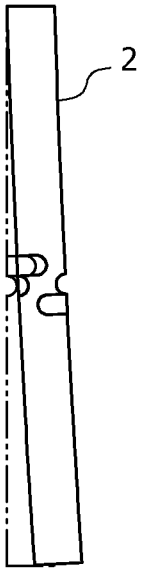
FIG. 6 is an explanatory view showing a state that the rotation support bar is deformed in the deformation analysis of the embodiments.
Figure 7:
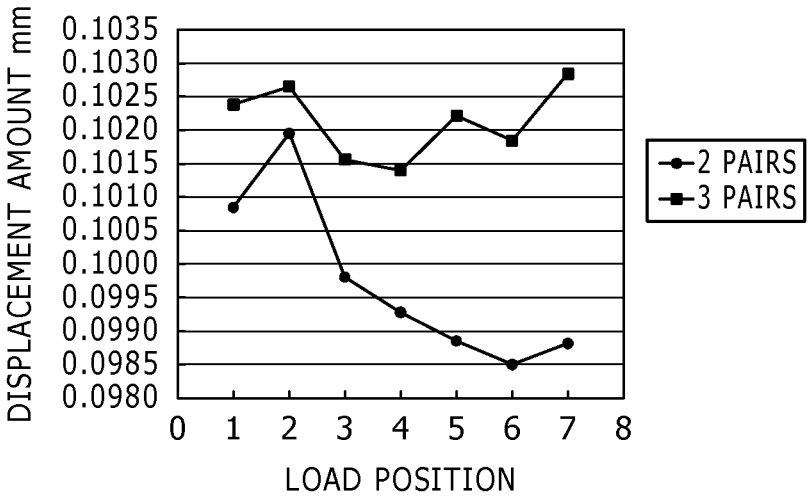
FIG. 7 is a graphical view showing a result of the deformation analysis of the embodiments.

Using the models of the rotation support bar of the grinding tool according to the present invention, the deformation analysis was conducted in such a manner that the upper end thereof is in a fixed state and a load of 1.5 kgf is applied to the lower end thereof. Specifically, the deformation analysis was conducted in such a way that the load direction is assumed to be the direction orthogonal to the axial direction of the rotation support bar and the load direction is changed at 15° pitch as shown in FIG. 5. In addition, the load direction in which the deformation analysis was firstly conducted was temporarily assumed to be 0°, and subsequently, the load direction was assumed to be 15°, 30°, 45°, 60°, 75°, and 90°. The result of the conducted analysis is shown as 0° being a load position 1, 15° being a load position 2, 30° being a load position 3, 45° being a load position 4, 60° being a load position 5, 75° being a load position 6, and 90° being a load position 7. For reference, FIG. 6 shows a state that the rotation support bar is deformed. The result is as shown in Table 1 and FIG. 7.

TABLE 1

(Unit: mm)

| Load position | 4 grooves in 2 pairs type | 6 grooves in 3 pairs type |
|---|---|---|
| 1 | 0.100900 | 0.102404 |
| 2 | 0.101960 | 0.102655 |
| 3 | 0.099815 | 0.101593 |
| 4 | 0.099284 | 0.101395 |
| 5 | 0.098859 | 0.102193 |
| 6 | 0.098511 | 0.101848 |
| 7 | 0.099880 | 0.102805 |
| Maximum difference in displacement amount | 0.003449 | 0.001410 |

Whereas the maximum difference in displacement amount in the model provided with two pairs of grooves (four in total) is about 3.4 μm, the maximum difference in displacement amount in the model provided with three pairs of grooves (six in total) is about 1.4 μm. Thus, it can be said that the more grooves the model is formed with in the outer peripheral surface of the rotation support bar, the smaller the maximum difference in displacement amount. In addition, in the model provided with one pair of grooves (two in total), it can be assumed that the displacement amount in a case where a load is applied to the same direction as the length direction of the grooves becomes a small displacement amount that is unsuitable for grinding a curved surface or a nonuniform surface, and that the maximum difference in displacement amount further increases than the model provided with two pairs of grooves (four in total).

In addition, it should be considered that the embodiments disclosed herein are illustrative and not restrictive in all respects. In particular, in the embodiments disclosed herein, the matters which are not explicitly disclosed, such as the running condition and the operating condition, the various parameters, the dimension, weight, volume of the components and the like, do not depart from the scope ordinarily implemented by those of skill in the art, and the values that can be readily contemplated by those of ordinary skill in the art are adopted. The present application is based on Japanese Patent Application (JP 2013-035985) filed on Feb. 26, 2013, the contents of which are incorporated herein by reference.

EXPLANATION OF REFERENCE NUMERALS

1: Grinding tool
2: Rotation support bar
3: Grinding stone tip
4: Hinge part
4*a*: Groove
4*b*: Virtual line
5: Balancer

The invention claimed is:

1. A grinding tool having a columnar rotation support bar, and a grinding stone tip provided at a leading end of the rotation support bar, wherein the rotation support bar has a bendable hinge part at the intermediate portion thereof, and has a balancer which suppresses the occurrence of balance failure during rotation on the grinding stone tip side than the hinge part, the hinge part consists of two or more opposed pairs of grooves which have circular arc-shaped bottom surfaces and which are provided in the outer peripheral surface of the rotation support bar so as to extend in the direction orthogonal to the axial direction of the rotation support bar, and the respective grooves are provided at equiangular intervals as viewed from the axial direction of the rotation support bar.

2. The grinding tool according to claim 1, wherein the respective grooves are provided to be displaced in the axial direction of the rotation support bar so as not to intersect with each other.

3. The grinding tool according to claim 1, wherein the depth of the grooves is D/3-D/5 with respect to a diameter D of the rotation support bar.

4. The grinding tool according to claim 2, wherein the depth of the grooves is D/3-D/5 with respect to a diameter D of the rotation support bar.

* * * * *